US008123078B2

(12) United States Patent
Thomas, Jr.

(10) Patent No.: US 8,123,078 B2
(45) Date of Patent: Feb. 28, 2012

(54) FLEXIBLE PACKAGES FOR CONNECTION TO A DISPENSING SYSTEM AND CLAMPING DEVICES FOR RELEASABLY CONNECTING SUCH PACKAGES TO THE INLET TUBE OF A DISPENSING SYSTEM AND METHODS OF DISPENSING FLOWABLE MATERIALS FROM FLEXIBLE PACKAGES

(75) Inventor: John S. Thomas, Jr., Coopersburg, PA (US)

(73) Assignee: Fres-co System USA, Inc., Telford, PA (US)

( * ) Notice: Subject to any disclaimer, the term of this patent is extended or adjusted under 35 U.S.C. 154(b) by 338 days.

(21) Appl. No.: 12/426,418

(22) Filed: Apr. 20, 2009

(65) Prior Publication Data

US 2009/0266841 A1 Oct. 29, 2009

Related U.S. Application Data

(60) Provisional application No. 61/048,367, filed on Apr. 28, 2008.

(51) Int. Cl.
*B65D 37/00* (2006.01)
*B65D 47/10* (2006.01)
*B65D 33/00* (2006.01)
*B65D 33/36* (2006.01)

(52) U.S. Cl. ..... 222/92; 222/107; 222/541.6; 383/200; 383/906

(58) Field of Classification Search ..... 222/1, 92, 222/105–107, 541.6; 383/67, 200, 904, 906; 426/85

See application file for complete search history.

(56) References Cited

U.S. PATENT DOCUMENTS

| | | | | |
|---|---|---|---|---|
| 6,485,479 | B1 * | 11/2002 | Knierbein | 604/411 |
| 2003/0077010 | A1 * | 4/2003 | Schulz | 383/66 |
| 2005/0067432 | A1 * | 3/2005 | Bonneyrat | 222/105 |

* cited by examiner

*Primary Examiner* — Darren W Gorman

(74) *Attorney, Agent, or Firm* — Caesar, Rivise, Bernstein, Cohen & Pokotilow, Ltd.

(57) ABSTRACT

A flexible package for holding a flowable material therein and method of use to enable the flowable material to be introduced into a dispensing system via an inlet tube. The flexible package has a body portion and a projection which forms a mouth for the package and is in communication with the interior of the package. The projection is openable for receipt of the inlet tube and is arranged to be clamped into engagement with the inlet tube to form a fluid-tight interface by use of a clamping mechanism. The fluid-tight interface is releasable, when desired.

9 Claims, 3 Drawing Sheets

FLEXIBLE PACKAGES FOR CONNECTION TO A DISPENSING SYSTEM AND CLAMPING DEVICES FOR RELEASABLY CONNECTING SUCH PACKAGES TO THE INLET TUBE OF A DISPENSING SYSTEM AND METHODS OF DISPENSING FLOWABLE MATERIALS FROM FLEXIBLE PACKAGES

CROSS-REFERENCE TO RELATED APPLICATIONS

This application claims priority from Provisional Application Ser. No. 61/048,367, filed on Apr. 28, 2008, entitled Flexible Packages For Connection To A Dispensing System And Clamping Devices For Releasably Connecting Such Packages To The Inlet Tube Of A Dispensing System, which application is assigned to the same assignee as this application and whose disclosure is incorporated by reference herein.

STATEMENT REGARDING FEDERALLY SPONSORED RESEARCH OR DEVELOPMENT

"Not Applicable"

INCORPORATION-BY-REFERENCE OF MATERIAL SUBMITTED ON A COMPACT DISK

"Not Applicable"

FIELD OF THE INVENTION

This invention relates generally to flexible packages and more particularly to packages for holding products that are sensitive to the ambient atmosphere to enable the products to be introduced into a dispensing system, for devices for releasably securing such packages to dispensing systems and for methods of dispensing flowable materials from such packages.

BACKGROUND OF THE INVENTION

Prior art dispensing systems typically make use of some hopper or some other receptacle into which the product to be dispensed is introduced. The product is commonly provided to the dispensing system via a flexible package or pouch. The package is typically formed of a flexible material, e.g., 48 gauge polyester film, aluminum foil film, biaxially oriented nylon film, polyethylene film, etc., in a single ply or multiple plies, and is sealed to isolate the product from the ambient atmosphere. When it is desired to introduce the material from the package into a dispensing system, the package is torn open or cut open and its contents poured into a hopper or other receptacle of the dispensing system. While this arrangement may be suitable for materials that do not degrade when exposed to humidity in the ambient atmosphere, it is not suitable for materials that do degrade. Examples of such degradable materials are sodium chlorite and sodium dichloroisocyanurate dehydrate.

Thus, the need exists for a package which is particularly suited for connection to a dispensing system, so that when the package is opened and connected to the dispensing system, the contents of the package are nevertheless isolated from the ambient atmosphere.

The subject invention addresses that need by providing particularly configured flexible packages which are arranged to be readily connected to an input tube of the dispensing system and clamping devices for effecting such a connection in a good air-tight manner.

All references cited herein are incorporated herein by reference in their entireties.

SUMMARY OF THE INVENTION

In accordance with one aspect of this invention there is provided a flexible package for holding a flowable material therein to enable the flowable material to be introduced into a dispensing system via an inlet tube. The flexible package comprises a body portion formed of at least one sheet of a flexible packaging material and a projection. The body portion includes a hollow interior in which the flowable material is arranged to be located. The projection forms a mouth for the package and is in communication with the interior of the package. The projection is openable to form a passageway for receipt of the inlet tube therein. The projection is arranged to be clamped into engagement with the inlet tube to form a fluid-tight interface therebetween. The fluid-tight interface is releasable, when desired.

In accordance with another aspect of this invention a clamping mechanism is provided to releasably clamp the mouth of the package to the inlet tube. In one exemplary embodiment the clamping mechanism comprises a pair of pivotable jaws. In another exemplary embodiment the clamping mechanism comprises a twist lock cap.

In accordance with another aspect of this invention a method of for enabling the dispensing of flowable materials from a flexible package is provided. The method entails providing a dispensing system comprising an inlet tube through which the flowable material may be dispensed and providing a flexible package comprising a body portion formed of at least one sheet of a flexible packaging material and a projection. The body portion includes a hollow interior in which the flowable material is located. The projection forms a mouth for the package in communication with the interior of the package and is openable. The method additionally entails opening said projection to form a passageway, locating an inlet tube within the passageway and clamping the projection into engagement with the inlet tube to form a fluid-tight interface therebetween, with the fluid-tight interface being releasable. The flowable material can then be introduced from the flexible package through the inlet tube into the dispensing system.

DETAILED DESCRIPTION OF THE PREFERRED EMBODIMENT

Figure 1:
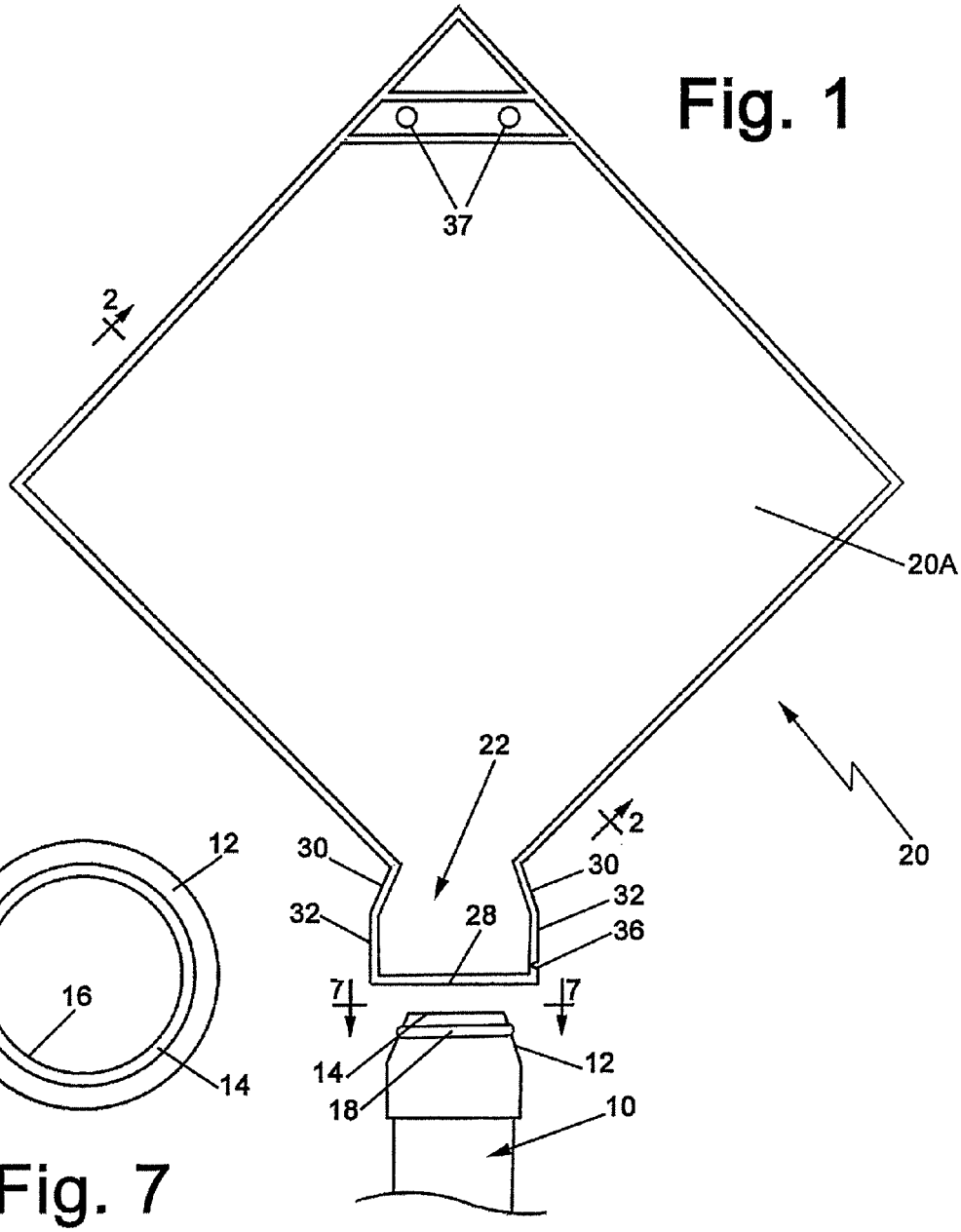
FIG. 1 is an illustration of one exemplary package constructed in accordance with this invention shown juxtaposed next to an inlet tube of a dispensing system to which the package is to be connected for introducing the flowable contents into the dispensing system.
Figure 7:
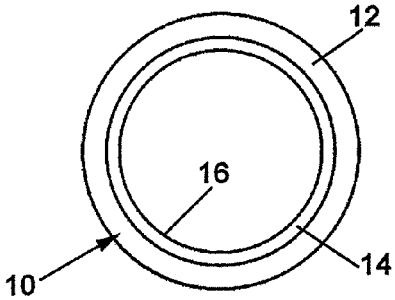
FIG. 7 is an enlarged view taken along line 7-7 of FIG. 1.

Referring now to the various figures of the drawing wherein like reference characters refer to like parts, there is shown in FIG. 1 an exemplary flexible package 20 for holding a flowable material (not shown), e.g., granular or particulate material, to isolate it from the ambient air. The package 20 includes a neck portion 22 that is particularly configured so that when it is opened (as will be described later) it forms a mouth arranged to readily accommodate an inlet tube of a dispensing system. In particular, the inlet tube 10 serves as an entryway or passageway to any vessel or other receptacle (not shown) of any type of dispensing system. One particular application for the subject invention is as a part of a system for dispensing water treatment chemicals, such as sodium chlorite and sodium dichloroisocyanurate dehydrate. Such a dispensing system may include a small hopper into which the water treatment chemicals are introduced via the inlet tube for subsequent dispensing into the water to be treated. As will be appreciated by those skilled in the art, sodium chlorite and sodium dichloroisocyanurate dehydrate, are a highly hygroscopic and must be protected (isolated) from the ravages of moisture in the ambient atmosphere, since they generate chlorine dioxide when exposed to water.

As best seen in FIG. 1 the outer surface 12 of the free end 14 of the exemplary inlet tube 10 is tapered. A passageway 16 extends through the inlet tube to the opposite end of that tube. That opposite end is arranged to be connected to the hopper or other vessel of the dispensing system. An O-ring 18 is provided in an annular groove extending about the periphery of the tapered outer surface 12 of the inlet tube 10. The O-ring 18 serves to cooperate with a portion of a clamping mechanism (to be described later) to ensure that the interface between the package's mouth and the inlet tube is a good fluid-tight or hermetic seal.

Figure 2:
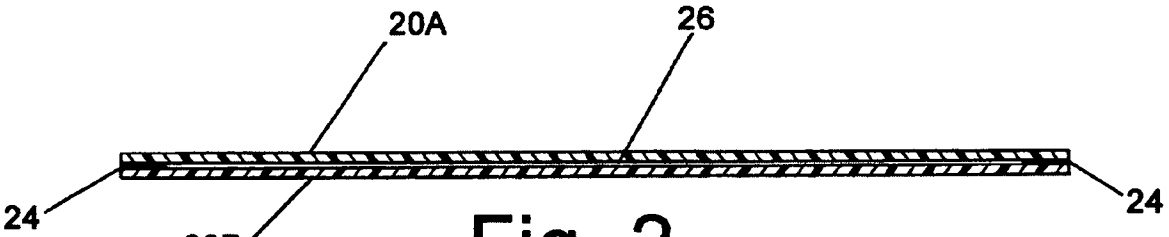
FIG. 2 is an enlarged sectional view taken along line 2-2 of FIG. 1.

The package 20 is in the form of a pouch which basically comprises body portion made up of a pair of flexible sheets or panels 20A and 20B formed of any suitable packaging material. Each sheet can by of a single ply or multiple plies (e.g., a laminate, co-extrusion or any other construction). The two panels 20A and 20B are juxtaposed with respect to each other and sealed together along their peripheries by a seal line 24 to form a hollow interior 26 (FIG. 2) into which the flowable product can be introduced and held. It should be pointed out at this juncture, that the package 20 can be formed of a single sheet or web of material that is folded along one of its sides, with the others of its sides being sealed by a peripheral seal line, like seal line 24 described above.

In the embodiment of the exemplary package 20 shown in FIG. 1, the panels 20A and 20B making up the body portion are of a generally square shape. That is merely exemplary. Thus, it is contemplated that the package can be of any desired shape, such as rectangular, circular, oval or any non-regular shape. What is required is that the package includes a neck portion projecting outward from some portion of the periphery of the package to receive the tapered end 12 of the inlet tube 10 of the dispensing system.

The size of the package can be any dimension desired for the particular application. In one exemplary embodiment, for holding the above identified water treatment chemicals, the package 20 may come in two sizes, namely, 440 mm by 440 mm for 15 pound packages and 495 mm by 495 mm for 22.5 pound packages.

As can be seen in FIG. 1, neck 22 of the package 20 basically comprises a protrusion in the form of an extension of the panels 20A and 20B. The protrusion projects outward from the periphery of the package at one of its corners. The neck 22 includes an opposed pair of outwardly flaring side edges 30, each terminating in a linear side edge 32. The angle of the flaring side edges 30 is approximately the same angle as the angle of taper of the inlet tube surface 12 to enable that portion of the inlet tube to be accommodated in the mouth when the neck of the package is opened to form the mouth, as will be described later. To that end, the spacing between the linear side edges 32 of the neck 22 is such to enable the contiguous portions of the mouth to accommodate the non-tapering (cylindrical) portion of the inlet tube 10.

The peripheral seal 24 also extends about the periphery of the portions of the panels 20A and 20B forming the neck 22 of the package so that the interior of the neck 22 will be in communication with the interior 26 of the body portion of the package. Thus, when the package 20 is filled and sealed its contents are held within the hollow interior 26 of the package and isolated from the ambient atmosphere. If the material to be held within the package is highly hygroscopic, such as sodium chlorite and sodium dichloroisocyanurate, the material making up the package's walls is/are chosen to be resistant to the passage of moisture vapor therethrough. One example of a suitable material for that application is a film in the form of a laminate of 48 gauge polyester/28 gauge aluminum foil/60 gauge biaxial nylon/6.0 mil LLDPE (The "/" denotes a layer of adhesive bonding the films together).

In order to enable the package's neck 28 to be readily opened to form the mouth for receipt of the tapered end of the inlet tube 10 when it is desired to introduce some of the flowable material contents of the package into the dispensing system, a tear notch 36 is provided in a portion of the peripheral seal 24. In particular, the tear notch 36 is located in the edge of the package's neck 22, just slightly inward of the portion 28 of the peripheral seal 24 at the end of the neck 22. Accordingly, when it is desired to open the package and to connect it to the inlet tube 10, the user merely has to grasp the package and tear it across its neck 22, using the notch 36 as the starting point for the tear. This opens the neck 22 of the package to form its mouth. With the mouth now being open, the package can be moved relative to the inlet tube 10 to insert the inlet tube within the mouth. Since the mouth of the package is flared and the free end of the inlet tube is tapered, with the angle of flare/taper being the same, the insertion of the tapered end of the inlet tube into the package's mouth will bring those portions into engagement at an interface.

Inasmuch as the product (e.g., the water treatment chemical) held within the package 20 is highly hygroscopic, it is desirable that the interface between the mouth of the package and the inlet tube be sealed or otherwise resistant to the ingress of moisture therethrough, particularly if the entire contents of the package 20 are not to be introduced into the dispensing system at one time, i.e., the contents of the package will flow into the dispensing system over time. That will usually be the case if the dispensing system is part of a water treatment system for dispensing water treatment chemicals like those described above, since those chemical are commonly dispensed over a prolonged period of time. Accordingly, the packages of the subject invention are particularly suited to make use of a clamping mechanism to clamp the inner surface of the mouth of the package into intimate engagement with the outer surface of the inlet tube. Any type of clamping device can be utilized, providing that it makes a good, releasably securable seal around the entire periphery of the interface between the package's neck/mouth and the inlet tube. Two such exemplary clamping mechanisms are shown and described herein. However, other clamping mechanisms or devices can be used as well.

Figure 4:
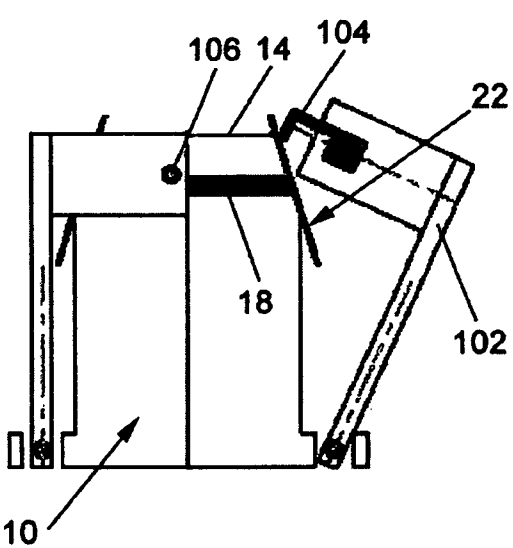
FIG. 4 is an enlarged side view of the portion of the clamping mechanism of FIG. 3, shown in the process of sealing the mouth portion of the package to the inlet tube.
Figure 3:
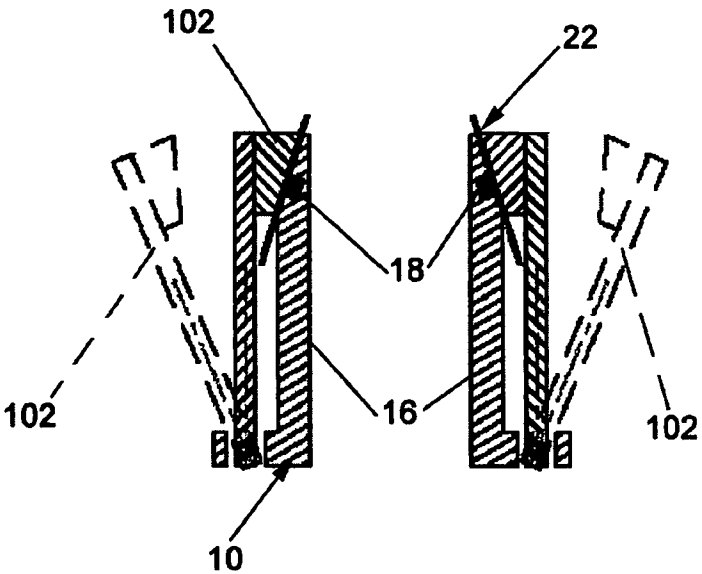
FIG. 3 is an enlarged, vertical sectional view of the portion of one exemplary embodiment of a clamping mechanism for releasably securing, i.e., sealing, the mouth portion of the package to the inlet tube to form a fluid-tight or hermetic interface therebetween.

In FIGS. 3 and 4 there is shown one exemplary embodiment of a clamping mechanism 100 constructed in accordance with this invention. That mechanism makes use of a pair of pivoting jaws 102. Each of the jaws includes a tapered, semi-circular cylindrical inner surface which corresponds to the taper of the inlet tube. The jaws 102 are like clam-shells in that they are pivotable from their open position (shown by the phantom lines in FIG. 3) to their operative or closed position (shown by the solid lines in that figure) and vice versa. When in the closed position the tapered jaws 102 conjoin to form a tapered surface that is complementary to the tapered surface 12 of the inlet tube 10 to thereby tightly engage the outer surface of the package's mouth 22. This action has the effect of slightly compressing the O-ring 18 between the inner surface of the package's mouth and the tapered surface 12 of the inlet tube 10, thereby further enhancing the seal at the interface.

As best seen in FIG. 4 the clamping mechanism makes use of a latch 104 on one of its jaws 102 and a latch pin 106 on the other of its jaws 102. Thus, when the jaws 102 are in their closed position the latch 104 can be brought into engagement with the latch pin 106 to hold the jaws in their closed position. This action effectively forms an excellent fluid-tight or hermetic seal preventing moisture in the ambient atmosphere from gaining ingress into the interior 26 of the package through that interface. Removal of the package 20 once its contents have been emptied into the dispensing system can be readily accomplished by merely opening the latch 104 and pivoting the jaws 102 open. A new filled package 20 can then be releasably secured to the inlet tube 10 in the same manner as described above.

Figure 6:
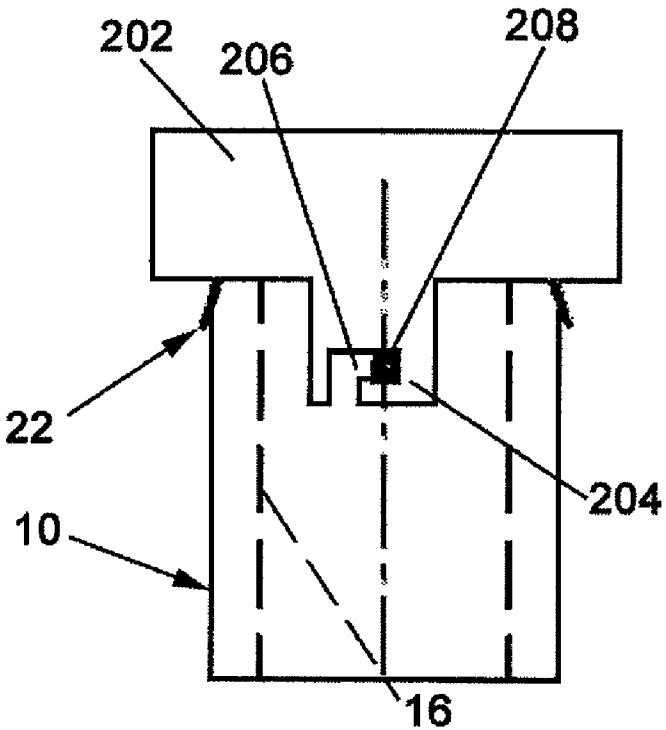
FIG. 6 is an enlarged side view of the portion of the clamping mechanism of FIG. 5, shown in its operative or fully closed position sealing the neck portion of the package to the inlet tube.
Figure 5:
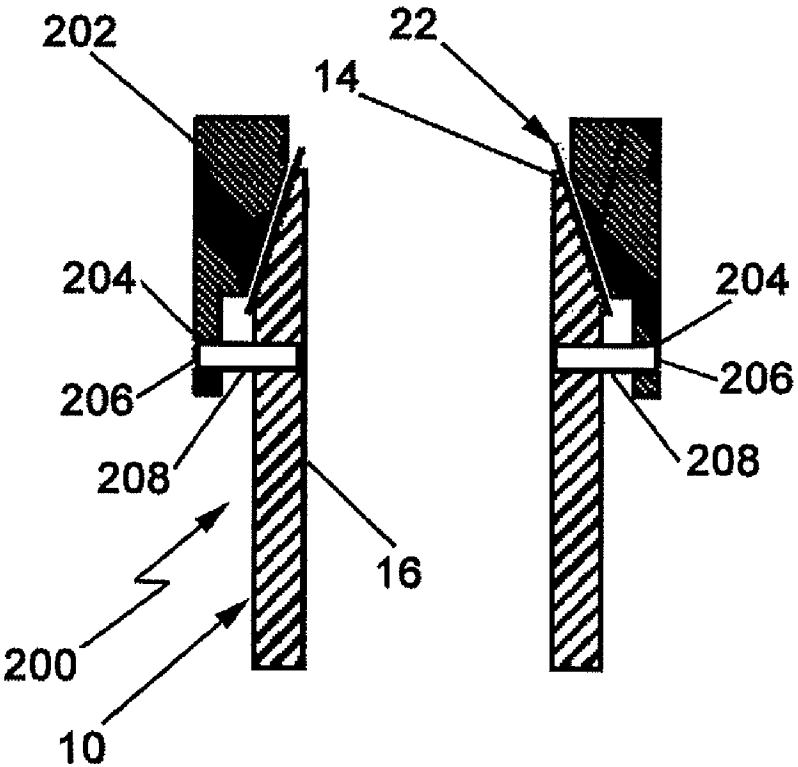
FIG. 5 is an enlarged, vertical sectional view of the portion of another exemplary embodiment of a clamping mechanism for releasably securing, i.e., sealing, the mount portion of the package to the inlet tube of the dispensing system.

In FIGS. 5 and 6 a second embodiment 200 of a clamping mechanism constructed in accordance with this invention is shown. That mechanism basically comprises a ring-like twist lock cap 202 that includes a tapered inner surface of corresponding shape to the tapered outer surface 12 of the inlet tube 10. The twist lock cap is arranged to have the opened mouth 22 of the package 22 inserted through it so that the inlet tube is within the package's mouth as shown in FIG. 5. The twist lock cap 202 can then be twisted about its longitudinal axis so that its tapered surface 12 of the inlet tube 10. An O-ring (not shown) is provided on the inner surface of the twist lock cap to facilitate the formation of the fluid tight interface. In such an arrangement, the O-ring 18 on the inlet tube 10 may be eliminated. However, if desired two O-rings may be used, one on the tapered surface 12 of the inlet tube 10 and the other on the correspondingly shaped inner surface of the twist lock cap. In any case, in order to hold the twist lock cap 202 in its closed or locked position it includes a diametrically opposed pair of projections 204, each forming a latch groove 206. Each latch groove 206 is arranged to receive a respective latch pin 208 forming a portion of the inlet tube 10 when the twist cap 202 is twisted into in its fully closed position like shown in FIG. 6.

In order to facilitate the introduction of the contents of the package 20 into the inlet tube of the dispensing system, the package 20 may include one or more openings. Those openings enable the package to be suspended from any suitable support over the inlet tube of the dispensing system as shown in FIG. 1. To that end, as shown therein the exemplary embodiment of the package 20 includes a pair of openings 37 in the corner of the package located opposite the corner from which the neck 22 projects. A pair of seal lines 38, which intersect the peripheral seal line 24, isolates the openings 37 from the interior 26 of the package in which the flowable product is located.

As should be appreciated from the foregoing, the subject invention provides a flexible package that is formed of a material and is sealed to maintain its contents isolated from the ambient atmosphere. The package includes a specially shaped outlet, e.g., a flared mouth, which is arranged to be opened when desired, and when opened to be connected to an input tube of the dispensing system in a good air-tight interface. Various clamping mechanisms are provided in accordance with another aspect of this invention to achieve that end. Thus, when the package is opened and the input tube of the dispensing system located within the package's mouth the clamping mechanism is used to releasably clamp the portion of the package and the tube together thereby forming a generally air-tight interface between them, so that the contents of the package can flow out of the package, through the connected input tube into the dispensing system, thereby protecting the product from the ravages of moisture in the ambient air.

The mechanisms are arranged for releasably clamping the specially shaped outlet of the package to the input tube in an air-tight manner, but are releasable so that when all the contents of the flexible package have been introduced into the dispensing system through the input tube, the particular clamping mechanism used can be released to enable the empty flexible package to be removed. A new flexible package having the product for dispensing connected to the input tube can then be opened and connected to the input tube by use of the clamping mechanism to introduce its contents into the dispensing system.

Without further elaboration the foregoing will so fully illustrate my invention that others may, by applying current or future knowledge, adopt the same for use under various conditions of service.

I claim:

1. In combination a flexible package, a clamping mechanism, and an inlet tube, said inlet tube forming a portion of a dispensing system and including a tapered end portion having an outer surface and a sealing ring, said flexible package being arranged for holding a flowable material therein to enable the flowable material to be introduced into the dispensing system via said inlet tube, said flexible package comprising a body portion formed of at least one sheet of a flexible packaging material and a projection, said body portion including a hollow interior in which the flowable material is arranged to be located, said projection being flared, forming a mouth for the package and being in communication with said interior of said package, said projection being openable to form a passageway having an inner surface of a mating shape to said outer surface of said tapered end portion of said inlet tube to closely accommodate said inlet tube therein, with said outer surface of said inlet tube being located immediately adjacent said inner surface of said passageway, said projection being arranged to be releasably clamped into engagement with said inlet tube by said clamping mechanism to cause said inner surface of said passageway to engage said outer surface of said inlet tube with said sealing ring interposed therebetween to form a fluid-tight interface therebetween, said clamping mechanism being releasable to cause said fluid-tight interface to be released.

2. The combination of claim 1 additionally comprising a notch in a portion of said projection to enable said projection to be torn across it starting at said notch.

3. The combination of claim 1 wherein said clamping mechanism comprises a pair of pivotable jaws.

4. The combination of claim 1 wherein said clamping mechanism comprises a twist lock cap.

5. A method for enabling the dispensing of a flowable material from a flexible package comprising:

providing a dispensing system comprising an inlet tube through which a flowable material may be introduced into the flexible package, said inlet tube including a tapered end portion having an outer surface and a sealing ring;

providing a releasable clamping mechanism;

providing a flexible package comprising a body portion formed of at least one sheet of a flexible packaging material and a projection, said body portion including a hollow interior in which said flowable material is located, said projection being flared, forming a mouth for the package and being in communication with said interior of said package, said projection being openable to form a passageway having an inner surface of a mating shape to said outer surface of said tapered end portion of said inlet tube to closely accommodate said inlet tube therein;

opening said projection to form said passageway;

locating said inlet tube within said passageway, with said outer surface of said inlet tube being located immediately adjacent said inner surface of said passageway; and releasably clamping said projection into engagement with said inlet tube by said releasable clamping mechanism to cause said inner surface of said passageway to engage said outer surface of said inlet tube with said sealing ring interposed therebetween to form a fluid-tight interface therebetween.

6. The method of claim 5 wherein said flexible package additionally comprises a notch in a portion of said projection and wherein said method additionally comprises tearing said projection thereacross starting at said notch to open said projection and form said passageway.

7. The method of claim 5 additionally comprising introducing the flowable material from said flexible package through said inlet tube into said dispensing system.

8. The method of claim 5 wherein said releasably clamping is accomplished by use of a pair of pivotable jaws.

9. The method of claim 5 wherein said releasable clamping mechanism comprises a twist lock cap and wherein said twist lock cap is used to releasably clamp said projection into engagement with said inlet tube.

* * * * *